US006501209B2

(12) United States Patent
Totsuka et al.

(10) Patent No.: US 6,501,209 B2
(45) Date of Patent: Dec. 31, 2002

(54) PIEZOELECTRIC TRANSFORMER DRIVING CIRCUIT

(75) Inventors: Masaaki Totsuka; Kachiyasu Satoh; Takahiro Inokuchi; Toshihiro Takahashi, all of Tsurugashima (JP)

(73) Assignee: Toko Kabushiki Kaisha, Tokyo-To (JP)

( * ) Notice: Subject to any disclaimer, the term of this patent is extended or adjusted under 35 U.S.C. 154(b) by 173 days.

(21) Appl. No.: 09/742,004

(22) Filed: Dec. 22, 2000

(65) Prior Publication Data

US 2001/0005107 A1 Jun. 28, 2001

(30) Foreign Application Priority Data

Dec. 22, 1999 (JP) ..... 11-364781

(51) Int. Cl.[7] ..... H01L 41/08; H03B 37/02
(52) U.S. Cl. ..... 310/316.01; 315/209 PZ
(58) Field of Search ..... 310/316.01, 317, 310/319, 358, 359, 366; 315/209 R, 209 PZ, 307, 224

(56) References Cited

U.S. PATENT DOCUMENTS 6,075,325 A * 6/2000 Kouno et al. ..... 315/307
6,118,221 A * 9/2000 Kumasaka et al. ... 315/209 PZ
6,153,962 A * 11/2000 Noma et al. ..... 310/316.01

* cited by examiner

*Primary Examiner*—Mark O. Budd
(74) *Attorney, Agent, or Firm*—Pillsbury Winthrop LLP

(57) ABSTRACT

A piezoelectric transformer driving circuit comprises a piezoelectric transformer which boosts an input voltage to obtain a voltage required in igniting a cold cathode tube, a restart circuit which detects the voltage output from said piezoelectric transformer and allows said piezoelectric transformer to repeatedly output a high voltage required in initially igniting said cold cathode tube, a PWM controller which allows said piezoelectric transformer to intermittently output a voltage in order to adjust the brightness of said cold cathode tube, and a stopping unit which stops the control operation of said PWM controller when restart circuit is operative.

2 Claims, 3 Drawing Sheets

PIEZOELECTRIC TRANSFORMER DRIVING CIRCUIT

BACKGROUND OF THE INVENTION

1. Field of the Invention

The present invention relates to a piezoelectric transformer driving circuit for igniting a cold cathode tube, and more particularly relates to the circuit which can obtain sufficient restart output when using PWM light modulation.

2. Description of the Related Art

Conventionally, a wire wound transformer is used in devices which require high voltage, such as a cold cathode tube, a copying machine, and an electrostatic remover.

In recent years, however, a piezoelectric transformer has started to be used for reasons that it can be miniturized and is more stable, etc. This piezoelectric transformer is used as a piezoelectric inverter, since its characteristics are suitable for igniting a cold cathode tube and it can be made thin.

In a piezoelectric inverter for igniting a cold cathode tube, a much higher output voltage is required at initial ignition than during continuous ignition. This is due to the characteristics of the cold cathode tube. For example, a cold cathode tube which can be continuously ignited at a voltage of between 200 to 300 V requires a voltage of more than 1 kV at initial ignition. An even higher voltage is required when the cold cathode tube has not been used for a while, or when it has been left in a cold place, and sometimes the cold cathode tube cannot be ignited by a single application of high voltage. As shown in FIG. 3, when the cold cathode tube ignites after a single application of high voltage, it can be continuously ignited at a constant voltage thereafter.

On the other hand, in case the cold cathode tube cannot be ignited after a single application of high voltage, a high voltage must be continuously or repeatedly applied to the cold cathode tube.

However, the stability of a miniaturized apparatus becomes a big problem when continuously generating a high voltage of more than 1 kV.

Accordingly, as shown in FIG. 4, a restart circuit is provided to control the output voltage over time and repeatedly output a high voltage. The high voltage is continuously output until the tube ignites.

The output voltage is time-divided by using a pulse in order to adjust the brightness (modulate the light) of the cold cathode tube when it is being continuously ignited. FIG. 5 shows the voltage output when the cold cathode tube is continuously ignited while adjusting its brightness.

In a circuit which adjusts brightness using a pulse as described above, the output of the restart circuit shown in FIG. 4 is also time-divided. As a result, only the cut output voltage shown in FIG. 6 can be obtained. Since the width of the pulse used in pulse light modulation is not synchronized to the cycle of the restart circuit, the number of maximum voltages generated is small. Shortening the cycle of the restart circuit would increase power consumption.

In the restart circuit, the secondary side voltage of the piezoelectric transformer is monitored, and, when it reaches the limit voltage, a control circuit reduces the output voltage of the piezoelectric transformer. In this case, drive delay and the like of the restart circuit and the piezoelectric transformer cause a delay in the feedback loop, and the output voltage reaches its maximum just before the brightness adjusting pulse turns OFF. Unless the limit is determined, the delay causes an abnormal voltage exceeding the limit voltage to be generated at the next ON.

SUMMARY OF THE INVENTION

It is an object of this invention to provide a piezoelectric transformer driving circuit in which the output of the piezoelectric transformer is controlled by a brightness adjusting pulse, whereby restart output can be continuously output without being cut and a cold cathode tube can be reliably ignited.

In order to achieve the above objects, this invention provides a piezoelectric transformer driving circuit comprising a piezoelectric transformer which boosts an input voltage to obtain a voltage required in igniting a cold cathode tube; a restart circuit which detects the voltage output from the piezoelectric transformer and allows the piezoelectric transformer to repeatedly output a high voltage required in initially igniting the cold cathode tube; a PWM controller which allows the piezoelectric transformer to intermittently output a voltage in order to adjust the brightness of the cold cathode tube; and a stopping unit which stops the control operation of the PWM controller when the restart circuit is operative.

According to this constitution of the invention, the PWM controller becomes operative when the restart circuit is operative. Therefore, the voltage output from the piezoelectric transformer is disjointed as shown in FIG. 6, but achieves the original continuously repeated output as shown in FIG. 4. The PWM controller becomes operative after initial ignition, obtaining an intermittent output voltage such as that shown in FIG. 5.

DESCRIPTION OF THE PREFERRED EMBODIMENT

A preferred embodiment of this invention will be explained with reference to the drawings.

Figure 1:
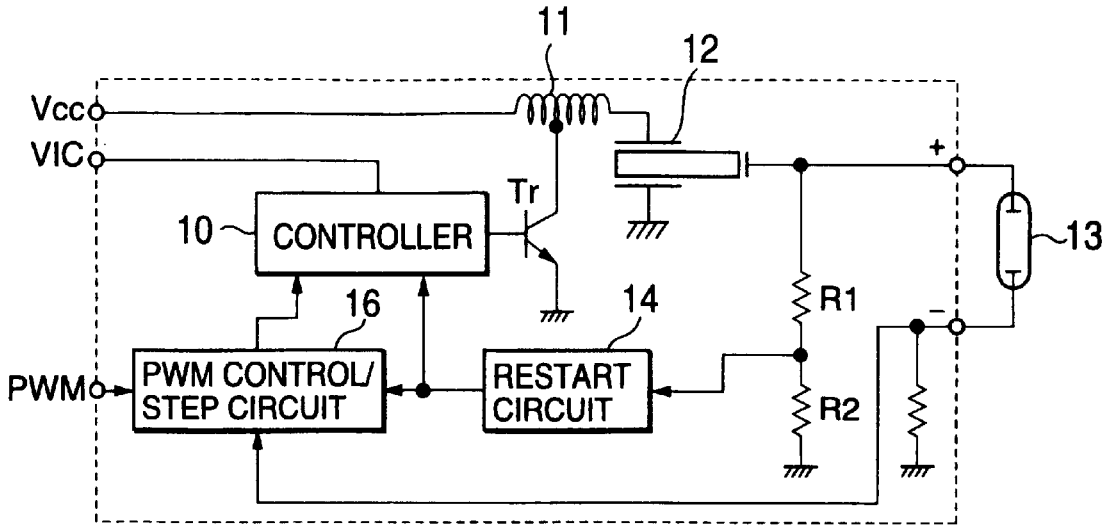
FIG. 1 is a block diagram showing a circuit arrangement of an embodiment of the inventions.

FIG. 1 is a block diagram showing the circuit constitution of an embodiment of this invention. In this circuit, a wire wound transformer 11 and a piezoelectric transformer are driven by a drive signal which is applied via a transistor Tr from a controller 10, boosting an input voltage Vcc and obtaining a voltage required to ignite a cold cathode tube 13.

The boosting ratio is changed in accordance with the characteristics of the cold cathode tube 13, a high voltage being output at initial ignition and a comparatively low voltage being output thereafter. To achieve this, when the load impedance of the cold cathode tube 13 has decreased from its high original level to a low level after ignition, a detection signal of the impedance decrease is used to drive the piezoelectric transformer 12 so as to output a lower voltage.

Resistances R1 and R2 are connected to the output terminal of the piezoelectric transformer 12, thereby forming a voltage-splitter. The voltage-splitter detects the output voltage of the piezoelectric transformer 12, that is, the voltage applied to the cold cathode tube 13, and applies the detected voltage to a restart circuit 14.

Figure 3:
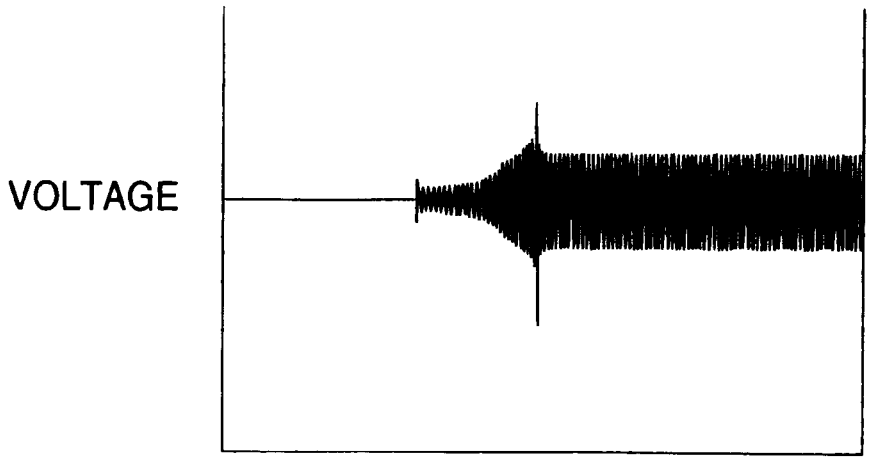
FIG. 3 is a diagram showing an output signal resulting from continuous operation after ignition has started.

Consequently, the restart circuit 14 becomes operative, and the piezoelectric transformer 12 repeatedly outputs a high voltage (see FIG. 4) which is required to initially ignite the cold cathode tube 13. When ignition has started, the drive output is switched to an output for continuous operation as shown in FIG. 3.

In this invention, when the restart circuit 14 is operating, a PWM control/stop circuit 16 becomes operative. In the embodiment shown in FIG. 1, the impedance of the cold cathode tube 13 is detected, and, when the detected impedance is high (i.e. when the voltage-splitter comprising the resistances R1 and R2 detects a high voltage), the PWM control/stop circuit 16 becomes operative.

Consequently, the drive signal PWM is stopped and is no longer input to the controller 10. Therefore, while the PWM control/stop circuit 16 is operating, the brightness adjustment of the cold cathode tube by PWM is stopped and a high voltage is cyclically applied in accordance with the output of the restart circuit 14.

Figure 2:
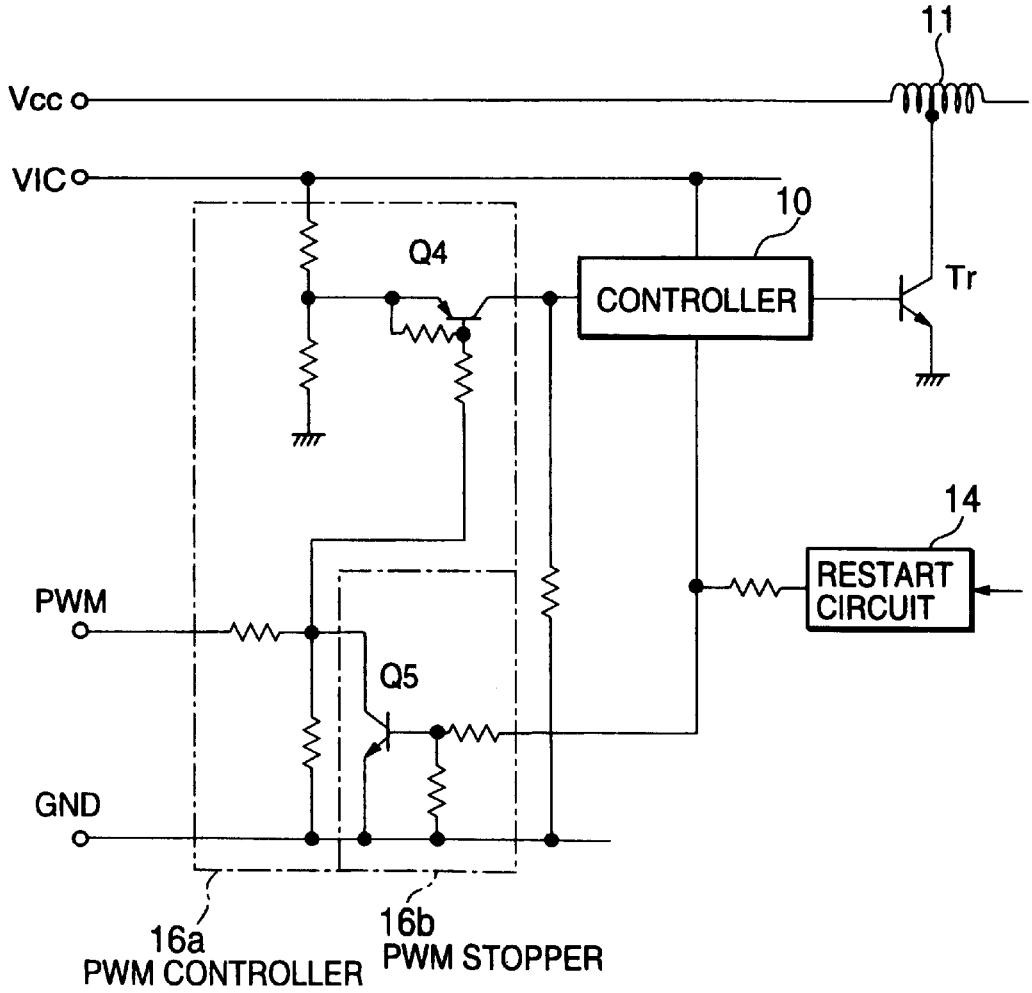
FIG. 2 is a circuit diagram showing PWM control/stop circuit 16 shown generally in FIG. 1.

FIG. 2 is a circuit diagram showing the PWM control/stop circuit 16 of FIG. 1 in greater detail. The PWM control/stop circuit 16 comprises a PWM controller 16*a* and a PWM stopper 16*b* which is combined with the PWM controller 16*a*.

The PWM control/stop circuit 16 comprising the PWM controller 16*a* and the PWM stopper 16*b* performs the following operations in accordance with the status of the cold cathode tube 13.

Figure 4:
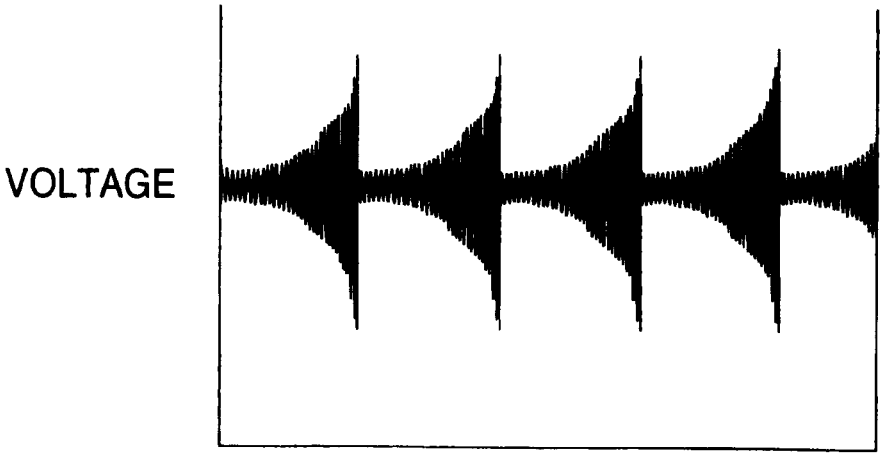
FIG. 4 is a diagram showing repeated high voltage outputs following operation of restart circuit 14.

(1) When the piezoelectric transformer 12 is not at the voltage of the ignition status of the cold cathode tube 13:

The restart circuit 14 becomes operative, the piezoelectric transformer 12 is controlled so as to output the waveform shown in FIG. 4, and the PWM control/stop circuit 16 is turned ON. Therefore, by switching ON the transistor Q5 of FIG. 2, the PWM input is decreased to GND and the transistor Q4 turns ON. Consequently, the voltage to terminal VIC is input to the controller 10.

(2) When the piezoelectric transformer 12 has reached the voltage of the ignition status of the cold cathode tube 13:

The restart circuit 14 becomes operative. Simultaneously, the PWM control/stop circuit 16 switches OFF. That is, by switching OFF the transistor Q5 of FIG. 2, the input from the terminal PWM is applied to the base of the transistor Q4, and the transistor Q4 switches ON and OFF in accordance with the PWM input. As the transistor Q4 switches ON and OFF in correspondence with the control pulse from the PWM terminal, the input voltage from the terminal VIC switches ON and OFF in accordance therewith and is applied to the controller 10.

Figure 5:
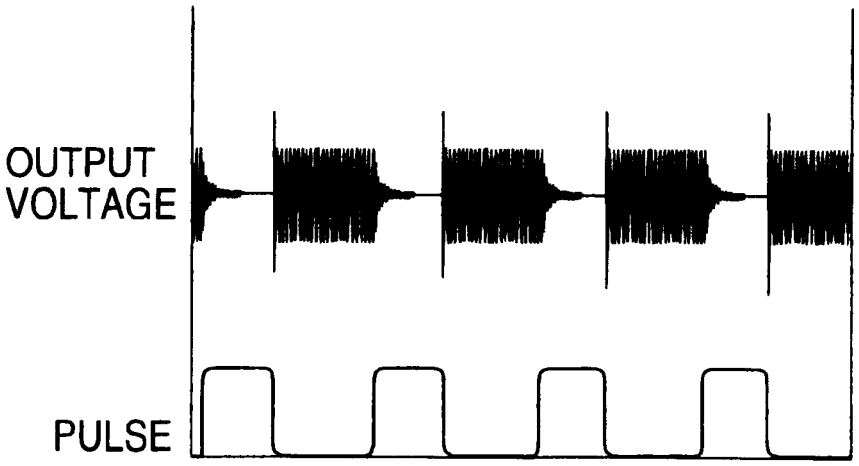
FIG. 5 is a graphical representation of intermittent output voltage occuring after the PWM controller becomes operative after initial ignition.
Figure 6:
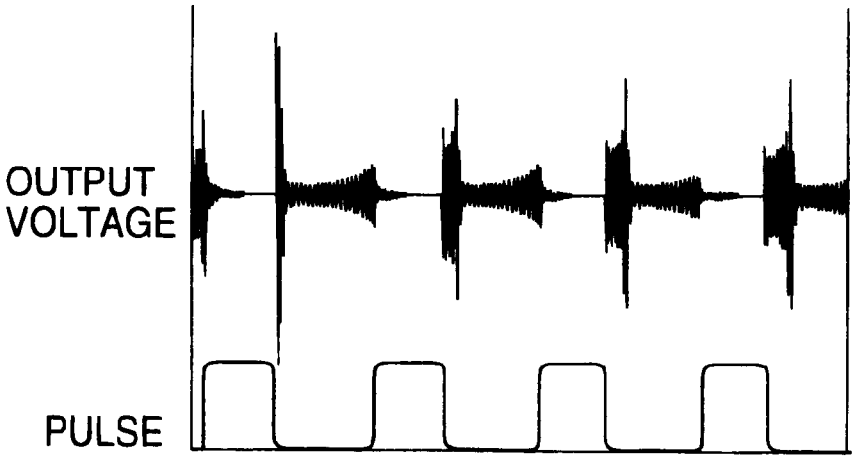
FIG. 6 is a graphic representation of the cut output voltage obtained when the output of the restart circuit shown in FIG. 4 is time divided.

As a consequence, since the controller 10 drives the wire wound transformer 11 and the piezoelectric transformer 12 by switching the transistor Tr ON and OFF, the piezoelectric transformer 12 outputs the waveform shown in FIG. 5.

In addition to the circuit constitution described above, this invention can be arranged in other circuit constitutions which have similar functions.

As described above, this invention is not affected by the PWM drive signal, and consequently can repeatedly output a high voltage which is not disjointed when the restart circuit becomes operative. Therefore, the cold cathode tube can be reliably ignited and abnormal voltages can be prevented. There is a further advantage that the inverter unit can be miniaturized, since the circuit constitution is basically achieved by adding only a transistor for switching.

What is claimed is:

1. A piezoelectric transformer driving circuit comprising:

a piezoelectric transformer which boosts an input voltage to obtain a voltage required in igniting a cold cathode tube;

a restart circuit which detects the voltage output from said piezoelectric transformer and allows said piezoelectric transformer to repeatedly output a high voltage required in initially igniting said cold cathode tube;

a PWM controller which allows said piezoelectric transformer to intermittently output a voltage in order to adjust the brightness of said cold cathode tube; and a stopping unit which stops the control operation of said PWM controller when said restart circuit is operative.

2. The piezoelectric transformer driving circuit as described in claim 1, further comprising a wire wound transformer for boosting said input voltage and applying it to said piezoelectric transformer.

* * * * *